US007870956B1

(12) United States Patent
Wang

(10) Patent No.: US 7,870,956 B1
(45) Date of Patent: Jan. 18, 2011

(54) TOOL STORAGE ASSEMBLY

(76) Inventor: Tzu-Chien Wang, No. 66, Gongye 3rd., Annan Dist., Tainan (TW)

( * ) Notice: Subject to any disclaimer, the term of this patent is extended or adjusted under 35 U.S.C. 154(b) by 0 days.

(21) Appl. No.: 12/831,311

(22) Filed: Jul. 7, 2010

(51) Int. Cl.
*B65D 85/28* (2006.01)

(52) U.S. Cl. ..... 206/373; 206/377; 206/379; 206/806

(58) Field of Classification Search ..... 206/349, 206/372–379, 806; 211/70.6; 224/666, 677, 224/679, 680–683, 904
See application file for complete search history.

(56) References Cited

U.S. PATENT DOCUMENTS 5,535,882 A * 7/1996 Liu ..... 206/377
6,050,409 A * 4/2000 Delbeck et al. ..... 206/375
6,978,890 B2 * 12/2005 Pangerc et al. ..... 206/377
6,988,616 B2 * 1/2006 Chen ..... 206/379
7,168,559 B2 * 1/2007 Chen ..... 206/373
7,677,391 B2 * 3/2010 Pistor et al. ..... 206/379
2003/0213760 A1 * 11/2003 Lee ..... 211/70.6
2005/0161356 A1 * 7/2005 Chen ..... 206/373
2009/0288974 A1 * 11/2009 Pistor et al. ..... 206/377

* cited by examiner

*Primary Examiner*—Luan K Bui
(74) *Attorney, Agent, or Firm*—Alan Kamrath; Kamrath & Associates PA

(57) ABSTRACT

A tool storage assembly has a storing mount and a protecting cover. The storing mount has a body. The body has multiple mounting recesses, a pivotal groove and a locking protrusion. The mounting recesses are formed in two outer sides of the storing mount at intervals. The pivotal groove is formed through one end of the body. The locking protrusion is formed on and protrudes from other end of the body. The protecting cover is pivotally connected to the storing mount and has a casing. The casing is pivotally connected to and mounted around the body of the storing mount and has two holding panels and a retaining board. The holding panels are respectively formed on and protrude downward from two sidewalls of the casing to mount around the mounting recesses. The retaining board is formed on and protrudes downward from the casing to mount around the body.

10 Claims, 8 Drawing Sheets

TOOL STORAGE ASSEMBLY

BACKGROUND OF THE INVENTION

1. Field of the Invention

The present invention relates to a storage assembly, especially to a tool storage assembly that can store tools easily and provide a burglarproof effect.

2. Description of the Prior Arts

A conventional tool storage assembly is used to store tools and has a mounting segment and a protecting cover. The protecting cover is pivotally connected to the mounting segment. However, the volume of the conventional tool storage assembly is large, and both of a user's hands are needed to open the conventional tool storage assembly and to take a tool out of the mounting segment. Additionally, when the user wants to use a bit in the mounting segment during operating a power tool, the user has to put the power tool down first and then change the bit on the power tool with another held in the mounting segment and this is inconvenient in use.

Furthermore, the mounting segment of the conventional tool storage assembly has multiple neck bushes corresponding to the shapes and the sizes of the tools. Therefore, each tool must be put into a specific neck bush to store and cannot be held in the other neck bushes. Moreover, the tools may be unauthorizedly removed from the conventional tool storage assembly.

To overcome the shortcomings, the present invention provides a tool storage assembly to mitigate or obviate the aforementioned problems.

SUMMARY OF THE INVENTION

The main objective of the present invention is to provide a tool storage assembly that can store tools easily and provide a burglarproof effect.

The tool storage assembly in accordance with the present invention has a storing mount and a protecting cover. The storing mount has a body. The body has multiple mounting recesses, a pivotal groove and a locking protrusion. The mounting recesses are formed in two outer sides of the storing mount at intervals and each mounting recess has two positioning claws. The pivotal groove is formed through one end of the body. The locking protrusion is formed on and protrudes from other end of the body opposite to the pivotal groove. The protecting cover is pivotally connected to the storing mount and has a casing. The casing is pivotally connected to and mounted around the body of the storing mount and has two holding panels and a retaining board. The holding panels are respectively formed on and protrude downward from two sidewalls of the casing to mount around the mounting recesses. The retaining board is formed on and protrudes downward from the casing to mount around the body.

Other objectives, advantages and novel features of the invention will become more apparent from the following detailed description when taken in conjunction with the accompanying drawings.

DETAILED DESCRIPTION OF PREFERRED EMBODIMENTS

Figure 1:
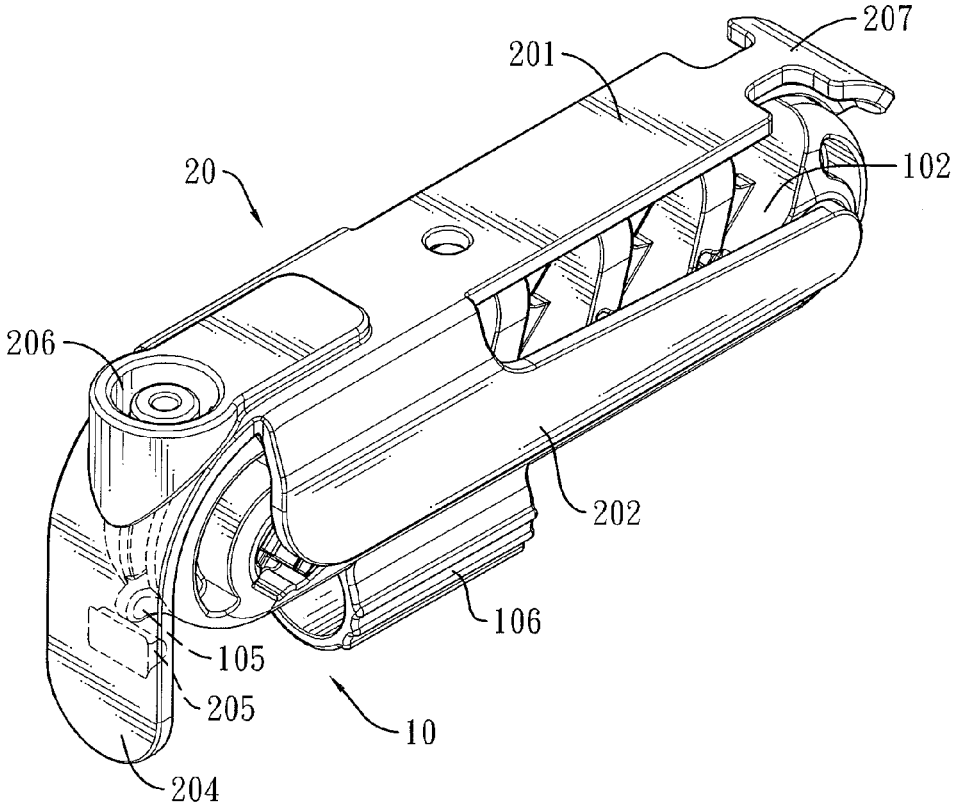
FIG. 1 is a perspective view of a first embodiment of a tool storage assembly in accordance with the present invention.
Figure 2:
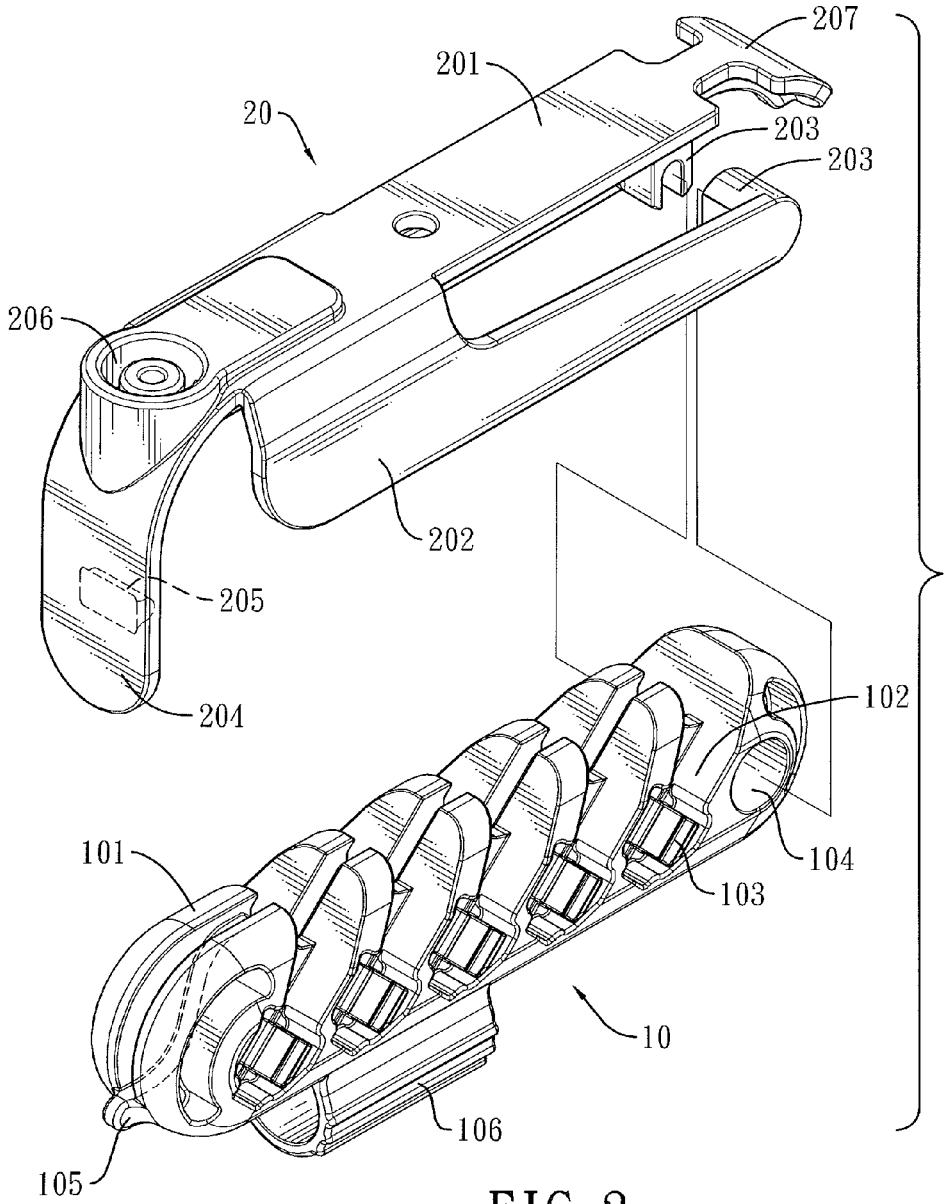
FIG. 2 is an exploded perspective view of the tool storage assembly in FIG. 1.
Figure 3:
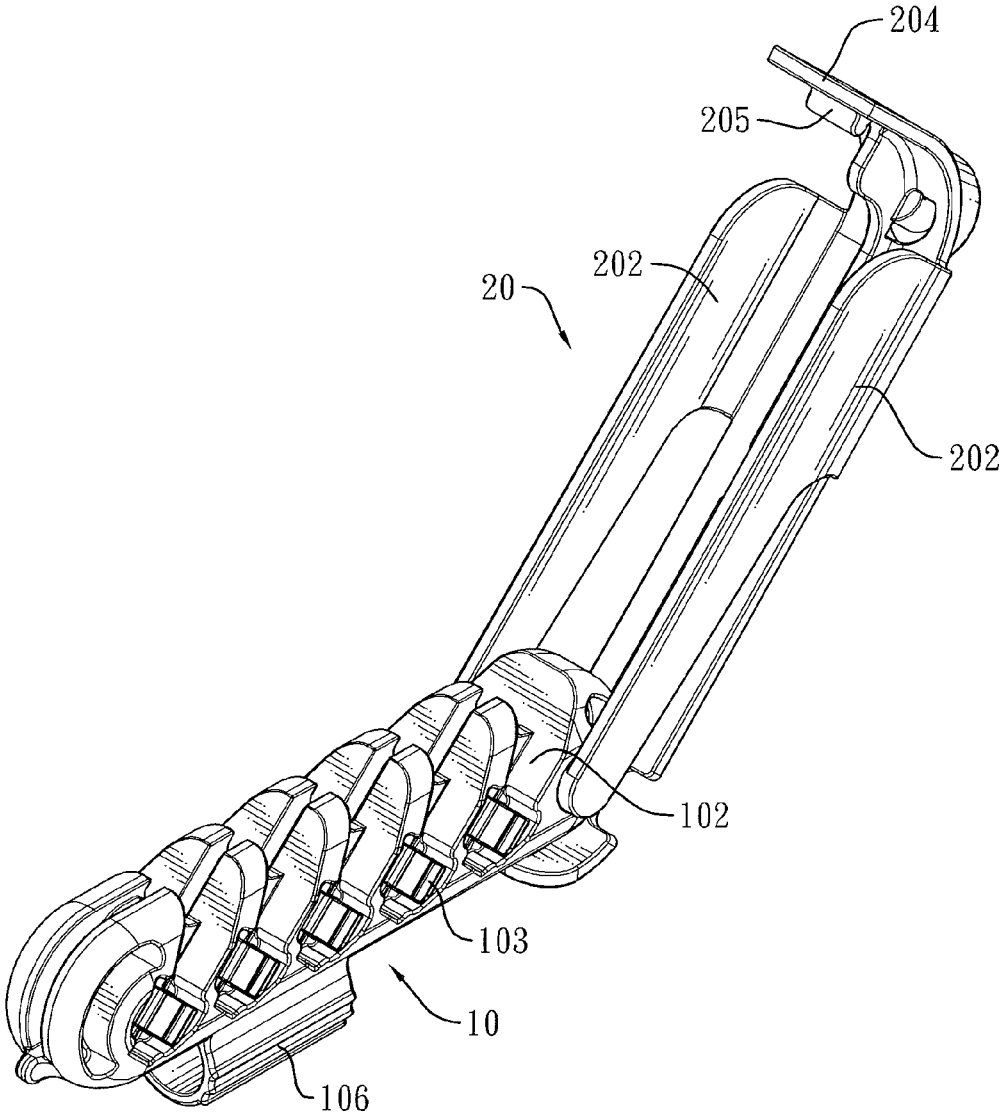
FIG. 3 is an operational perspective view of the tool storage assembly in FIG. 1.

With reference to FIGS. 1 to 3, a first embodiment of a tool storage assembly in accordance with the present invention has a storing mount 10 and a protecting cover 20.

The storing mount 10 has a body 101. The body 101 may be elongated and has two outer sides, a connecting end, a locking end, a top, a bottom, multiple mounting recesses 102, a pivotal hole 104, a locking protrusion 105 and a mounting tube 106.

Figure 9:
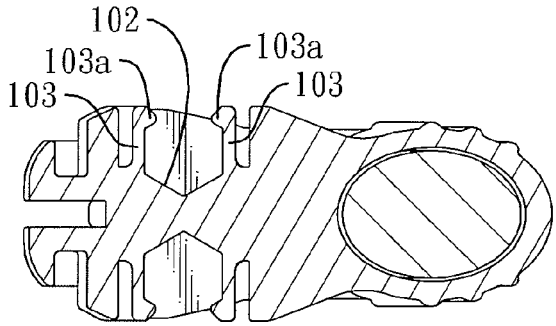
FIG. 9 is a cross sectional side view of the tool storage assembly along line 9-9 in FIG. 8.

The mounting recesses 102 are formed in the outer sides of the storing mount 10 on the top at intervals between the connecting end and the locking end to store bits and each mounting recess 102 has two internal surfaces and two positioning claws 103. With further reference to FIG. 9, the positioning claws 103 are formed on and protrude from the internal surfaces of the mounting recess 102 to abut and hold a corresponding bit and each positioning claw 103 has a free end and an inner protrusion 103*a* formed on and protruding from the free end to hold the corresponding bit.

The pivotal hole 104 is transversally formed through the connecting end of the body 101. The locking protrusion 105 is formed on and protrudes from the locking end of the body 101. The mounting tube 106 is hollow and is mounted on the bottom of the body 101 near the locking end to hold a screwdriver.

The protecting cover 20 is pivotally connected to the storing mount 10 and has a casing 201. The casing 201 is pivotally connected to and mounted around the body 101 of the storing mount 10 and has two sidewalls, two ends, a top, two holding panels 202, a retaining board 204 and a limiting panel 207.

The holding panels 202 are respectively formed on and protrude downward from the sidewalls of the casing 201 to mount over the mounting recesses 102 of the body 101 and each holding panel 202 has a connecting end and a pivotal arm 203. The pivotal arm 203 is formed on and protrudes from the connecting end of the holding panel 202 and is mounted rotatably in one end of the pivotal hole 104 of the body 101. Accordingly, the casing 201 can be pivoted relative to the body 101 at the pivotal arms 203.

Figure 4:
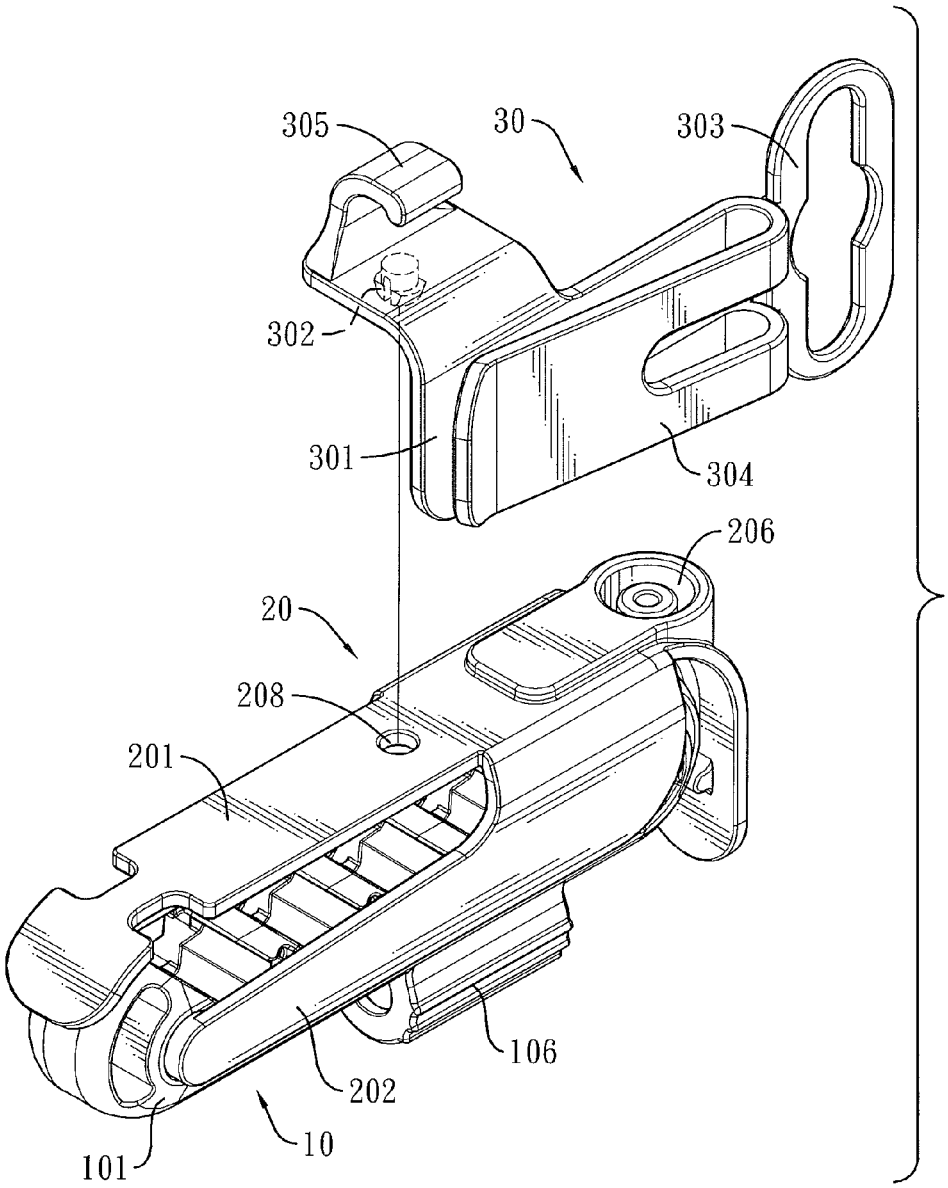
FIG. 4 is an exploded perspective view of a second embodiment of a tool storage assembly in accordance with the present invention.

The retaining board 204 is formed on and protrudes downward from an end of the casing 201 opposite to the pivotal arms 203, engages the locking end of the body 101 and has an extending end, an inner surface, a locking block 205, an inserting recess 206 and a rod hole 208. The extending end of the retaining board 204 extends from the bottom of the body 101 to align with the mounting tube 106. The locking block 205 is formed on and protrudes from the inner surface of the retaining board 204 and engages the locking protrusion 105 of the body 101 to hold the protecting cover 20 securely with the storing mount 10. The limiting panel 207 is curved, is formed on the other end of the casing 201 that is opposite to the retaining board 204 and selectively abuts with the bottom of the body 101 to prevent the casing 201 from over-rotating relative to the body 101 as shown in FIG. 3. With reference to FIG. 4, the inserting recess 206 is formed in the top of the casing 201 adjacent to the retaining board 204 to hold a head of a ratchet wrench. The rod hole 208 is formed through the top of the casing 201 between the limiting panel 207 and the inserting recess 206.

With reference to FIG. 4, a second embodiment of a tool storage assembly in accordance with the present invention has a similar structure as the storing mount 10 and the protecting cover 20 of a tool storage assembly of the first embodiment. The second embodiment of a tool storage assembly further has a hanging frame 30

The hanging frame 30 is detachably connected to the protecting cover 20 and has a hanging body 301. The hanging body 301 is detachably connected to the casing 201 and has an attaching end, a hanging end, a sidewall, a mounting rod 302, a holding arm 305, a hanging loop 303 and a clamping panel 304. The attaching end of the hanging body 301 is connected to the top of the casing 201 and has a top face and a bottom face. The mounting rod 302 is formed on and protrudes from the bottom face of the attaching end of the hanging body 301 and is mounted in the rod hole 208 of the casing 201. The holding ram 305 is curved and is formed on and protrudes from the top face of the attaching end of the hanging body 301 to hold a shank of the ratchet wrench with the head thereof held in the inserting recess 206. The hanging loop 303 is formed on the hanging end of the hanging body 301 opposite to the attaching end. The clamping panel 304 is curvedly formed on and protrudes from the hanging body 301 near the hanging loop 303 and parallels the sidewall of the hanging body 301.

Figure 5:
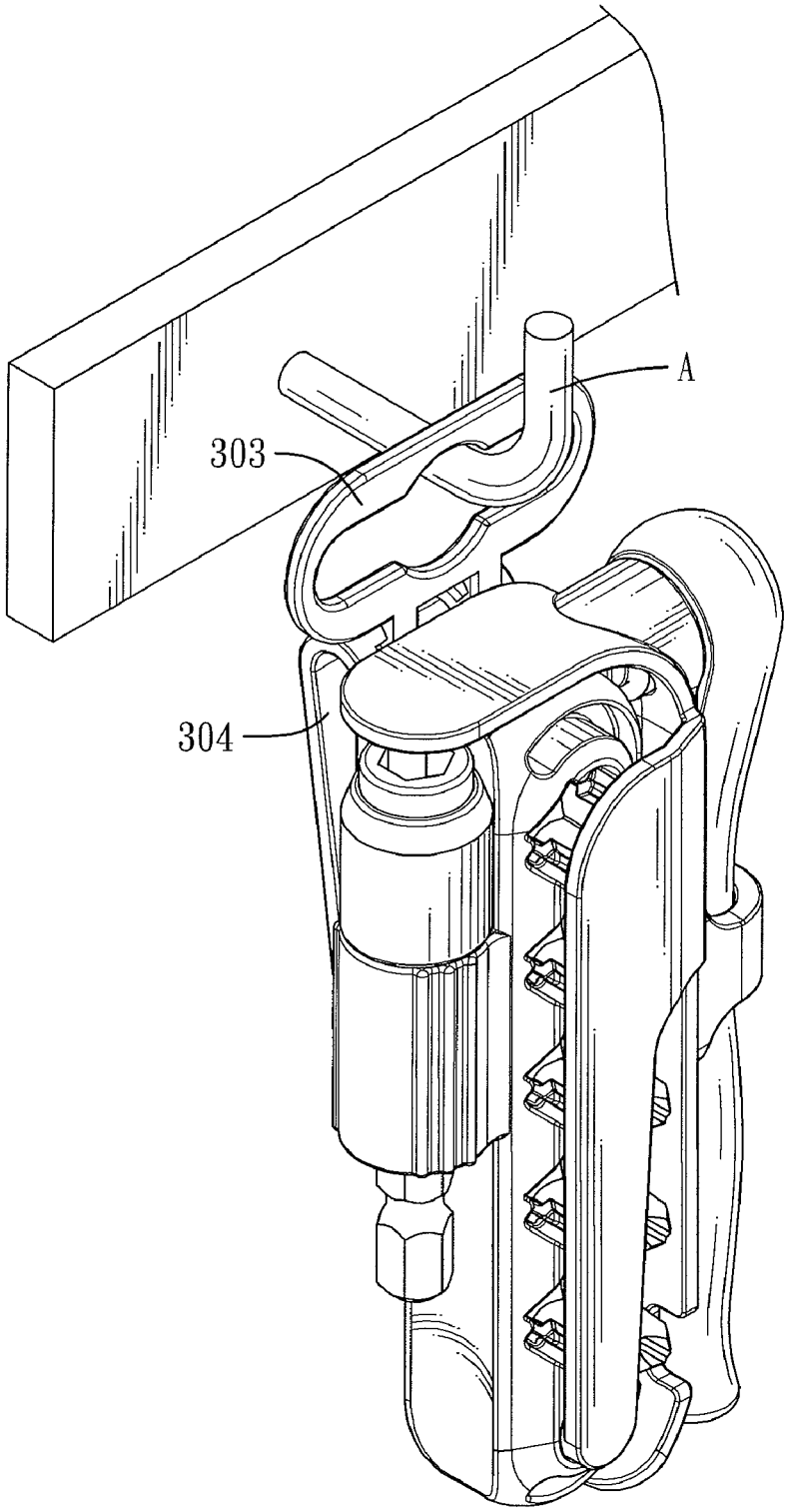
FIG. 5 is an operational perspective view of the tool storage assembly in FIG. 4 hanged on a hook.
Figure 6:
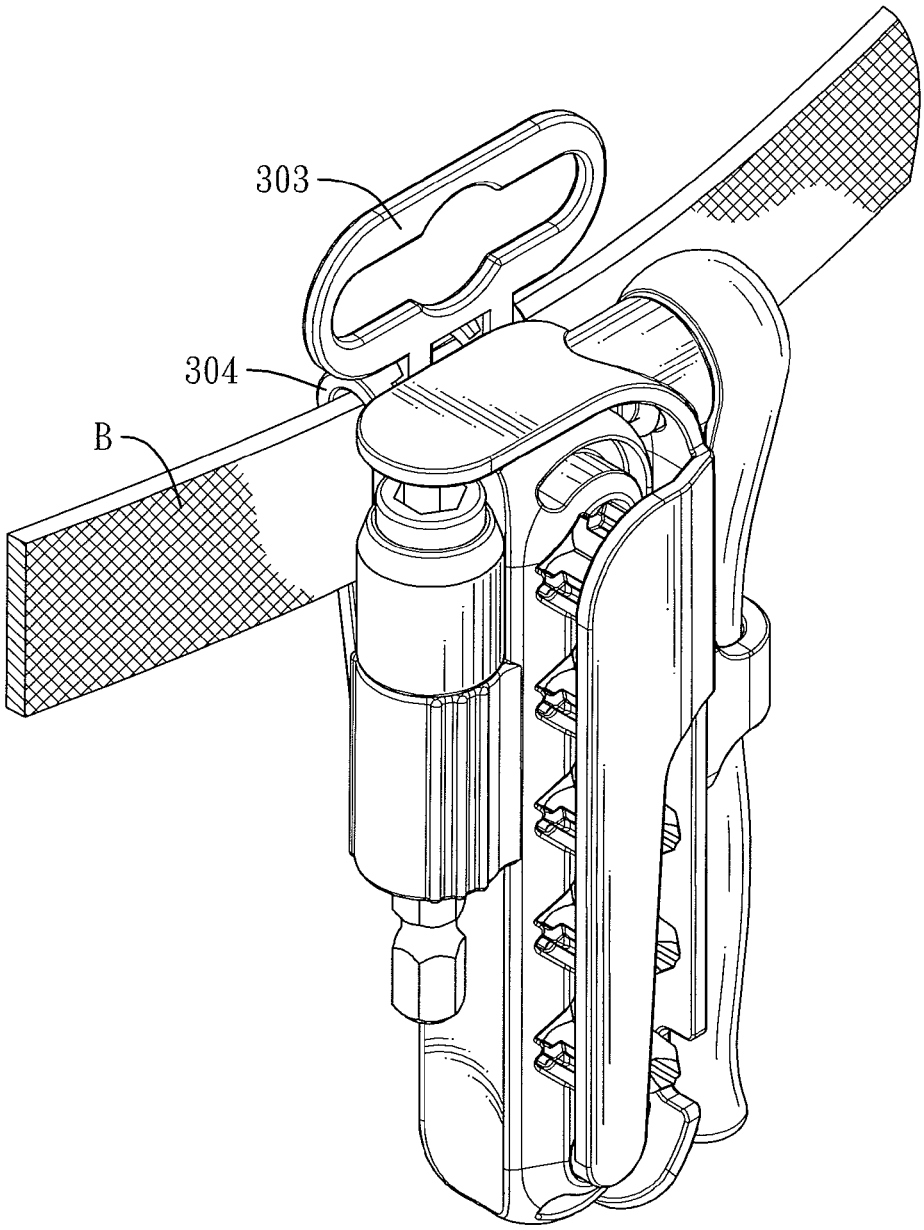
FIG. 6 is an operational perspective view of the tool storage assembly in FIG. 4 mounted on a waistband.
Figure 7:
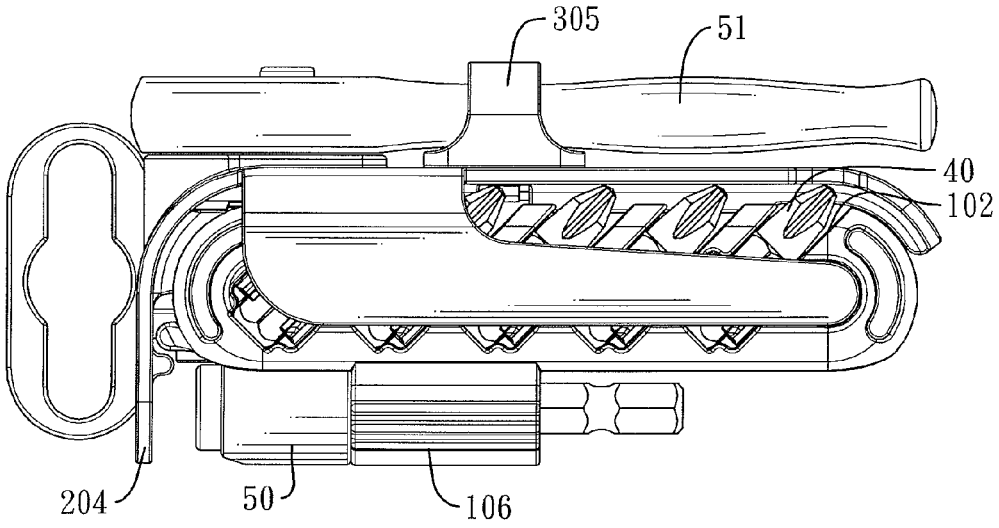
FIG. 7 is an operational side view of the tool storage assembly in FIG. 4 with multiple tools being mounted therein.

In use, with further reference to FIG. 5, the hanging loop 303 of the hanging frame 30 can be hanged on a hook A to hold the tool storage assembly at a fixed position. With reference to FIG. 6, the tool storage assembly can be held on a waistband B conveniently by the clamping panel 304 of the hanging frame 30. With reference to FIG. 7, a ratchet wrench 51 can be held between the casing 201 and the hanging body 301 by the inserting recess 206 and the holding arm 305. A screwdriver 50 can be mounted in the mounting tube 106 of the body 101. In addition, with reference to FIGS. 8 and 9, multiple bits 40 can be securely mounted in mounting recesses 102 by the inner protrusions 103*a* of the positioning claws 103.

Furthermore, with reference to FIG. 7, with the casing 201 covering over the body 101 of storing mount 10 and the locking block 205 engaging the locking protrusion 105 on the body 101, the bits 40 can be securely mounted in the tool storage assembly and cannot be taking out of the tool storage assembly unauthorizedly. In addition, when the locking block 205 of the casing 201 engages the locking protrusion 105 on the body 101, the extending end of the retaining board 204 aligns with the mounting tube 106 to cover an operation end of the screwdriver 50. The diameter of the operating end of the screwdriver 50 is larger than a diameter of the mounting tube 106, so the operating end of the screwdriver 50 can not be taken out of the mounting tube 106 by the retaining board 204 of the casing 201. Thus, a burglarproof effect to the bits 40 and the screwdriver 50 is provided.

Figure 8:
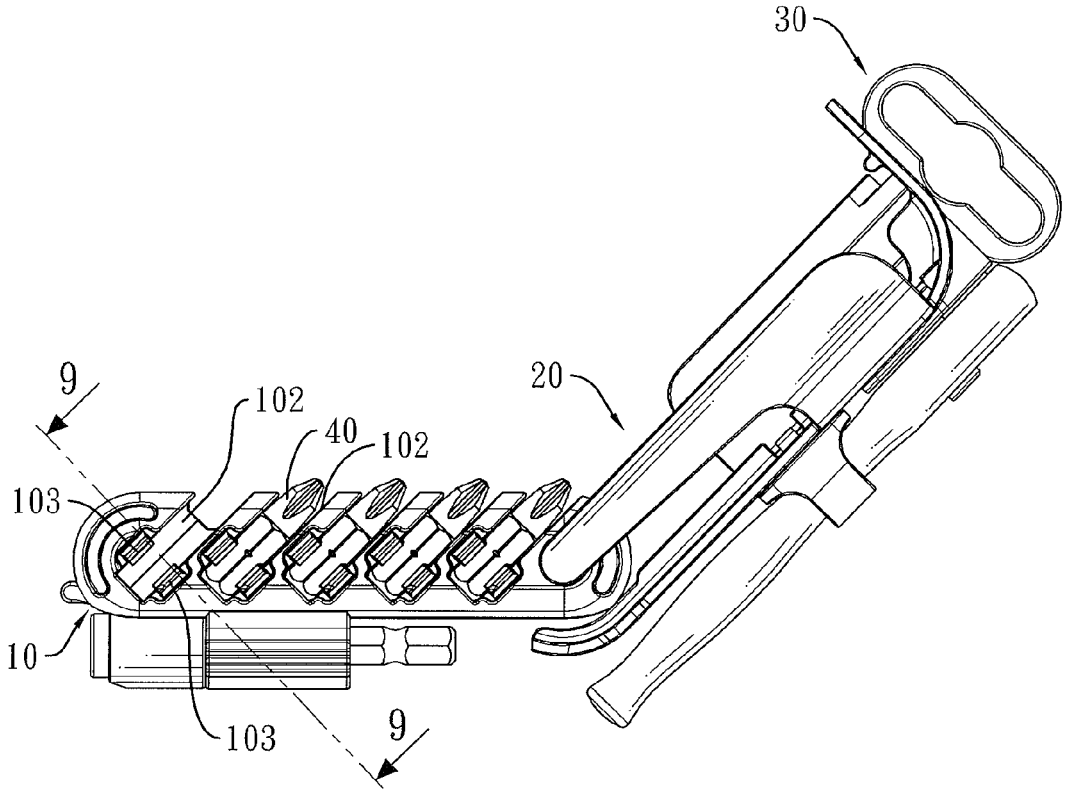
FIG. 8 is an operational side view of the tool storage assembly in FIG. 7.

When a user wants to get one of the bits 40 from the tool storage assembly in accordance with the present invention, with reference to FIG. 8, the protecting cover 20 is pivoted relative to the storing mount 10 until the limiting panel 207 abuts with the bottom of the body 101. Then, the user can take one of the bits 40 out of the mounting recesses 102 of the body 101 easily and conveniently without obstruction. Furthermore, the tool storage assembly in accordance with the present invention has a compact volume and can be hanged on a user's waist or a hook A by the hanging frame 30.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool storage assembly comprising
- a storing mount having
  - a body having
    - two outer sides;
    - a connecting end;
    - a locking end;
    - a top;
    - a bottom;
    - multiple mounting recesses formed in the outer sides of the storing mount on the top at intervals between the connecting end and the locking end and each mounting recess having
      - two internal surfaces; and
      - two positioning claws respectively formed on and protruding from the internal surfaces of the mounting recess;
    - a pivotal groove transversally formed through the connecting end of the body; and
    - a locking protrusion formed on and protruding from the locking end of the body opposite to the pivotal groove; and
- a protecting cover pivotally connected to the storing mount and having
  - a casing pivotally connected to and mounted around the body of the storing mount and having
    - two sidewalls;
    - two ends;
    - a top;
    - two holding panels respectively formed on and protruding downward from the sidewalls of the casing to mount around the mounting recesses of the body and each holding panel having
      - a connecting end extending to the pivotal groove of the body; and
      - a pivotal arm formed on and protruding from the connecting end of the holding panel and mounted in the pivotal groove of the body; and
    - a retaining board formed on and protruding downward from one of the ends of the casing that opposite to the pivotal arms to mount around the locking end of the body and having
      - an inner surface; and
      - a locking block formed on and protruding from the inner surface of the retaining board and engaging the locking protrusion of the body to hold the protecting cover securely with the storing mount.

2. The tool storage assembly as claimed in claim 1, wherein
- the casing has a rod hole formed through the top of the casing; and
- the tool storage assembly has a hanging frame detachably connected to the protecting cover and having a hanging body detachably connected to the casing and having an attaching end connected to the top of the casing and having a top face; and a bottom face;

a hanging end;

a sidewall;

a mounting rod formed on and protruding from the bottom face of the attaching end of the hanging body and mounted in the rod hole of the casing;

a holding arm being curved and formed on and protruding from the top face of the attaching end of the hanging body;

a hanging loop formed on the hanging end of the hanging body opposite to the mounting rod; and a clamping panel curvedly formed on and protruding from the hanging body near the hanging loop and parallel the sidewall of the hanging body.

3. The tool storage assembly as claimed in claim 2, wherein the storing mount has a hollow mounting tube mounted on the bottom of the body near the locking end; and the retaining board has an extending end extending to the bottom of the body to cover the mounting tube.

4. The tool storage assembly as claimed in claim 3, wherein each positioning claw of the mounting recess has a free end and an inner protrusion formed on and protruding from the free end of the positioning claw.

5. The tool storage assembly as claimed in claim 4, wherein the casing has an inserting recess formed in the top of the casing adjacent to the retaining board.

6. The tool storage assembly as claimed in claim 5, wherein the casing has a limiting panel being curved, formed on the other end of the casing that opposite to the retaining board and selectively abutting with the bottom of the body.

7. The tool storage assembly as claimed in claim 1, wherein the storing mount has a hollow mounting tube mounted on the bottom of the body near the locking end; and the retaining board has an extending end extending to the bottom of the body to cover the mounting tube.

8. The tool storage assembly as claimed in claim 1, wherein each positioning claw of the mounting recess has a free end and an inner protrusion formed on and protruding from the free end of the positioning claw.

9. The tool storage assembly as claimed in claim 1, wherein the casing has an inserting recess formed in the top of the casing adjacent to the retaining board.

10. The tool storage assembly as claimed in claim 1, wherein the casing has a limiting panel being curved, formed on the other end of the casing that opposite to the retaining board and selectively abutting with the bottom of the body.

* * * * *